US007258342B2

(12) United States Patent
Loewenstein et al.

(10) Patent No.: US 7,258,342 B2
(45) Date of Patent: Aug. 21, 2007

(54) CARD GAME WITH MOVING CARDS

(76) Inventors: David Allen Loewenstein, 802 King St., Rye Brook, NY (US) 10573; Martin Joel Wolff, 135 E. 83rd St., #11B, New York, NY (US) 10028

( * ) Notice: Subject to any disclaimer, the term of this patent is extended or adjusted under 35 U.S.C. 154(b) by 0 days.

(21) Appl. No.: 11/141,177

(22) Filed: May 31, 2005

(65) Prior Publication Data

US 2005/0236774 A1 Oct. 27, 2005

Related U.S. Application Data

(63) Continuation-in-part of application No. 10/418,829, filed on Apr. 21, 2003, and a continuation-in-part of application No. 10/156,381, filed on May 28, 2002, now abandoned, and a continuation-in-part of application No. 10/081,095, filed on Feb. 22, 2002.

(51) Int. Cl.
*A63F 1/00* (2006.01)

(52) U.S. Cl. ..... 273/292

(58) Field of Classification Search ..... 273/292
See application file for complete search history.

(56) References Cited

U.S. PATENT DOCUMENTS

| | | | | |
|---|---|---|---|---|
| 1,145,230 | A | 7/1915 | Culp | |
| 1,203,498 | A | 10/1916 | Culp | |
| 1,390,824 | A | 9/1921 | Silliman | |
| 1,418,020 | A | 5/1922 | Reach | |
| 1,541,925 | A | 6/1925 | Davidson | |
| 1,568,206 | A | 1/1926 | Brandt | |
| 1,684,813 | A | 9/1928 | Ward | |
| 1,745,373 | A | 2/1930 | Landsberger | |
| 2,663,418 | A | 12/1953 | Grunwald | |
| 2,776,498 | A | 1/1957 | MacDonald | |
| D204,993 | S | 6/1966 | Brothers | |
| 3,428,323 | A | 2/1969 | Fried | |
| 3,672,680 | A * | 6/1972 | Grey | 273/260 |

(Continued)

FOREIGN PATENT DOCUMENTS

GB 8744 0/1912

(Continued)

OTHER PUBLICATIONS

Split http:/kumquat.com/cgi-kumquat/funagain/131170?UCmiz5u::45.

(Continued)

*Primary Examiner*—Eugene Kim
*Assistant Examiner*—Dolores R. Collins
(74) *Attorney, Agent, or Firm*—David Loewenstein

(57) ABSTRACT

A card game where cards are arranged in columns, rows or circles that move in random or pseudo-random fashion. The player uses a point device to cause a line to intersect the cards. The cards that are intersected form the player's hand. The game can be played with split representation cards that are designed so that when the card is first displayed, either the suit or the rank is displayed, but both the suit and the rank are not displayed together. When the player selects the card, both the suit and the rank are displayed together as in a conventional card.

6 Claims, 9 Drawing Sheets

U.S. PATENT DOCUMENTS

| | | | | | |
|---|---|---|---|---|---|
| 3,776,554 | A | * | 12/1973 | Capablanca et al. | 273/261 |
| 3,817,533 | A | | 6/1974 | Leidenfrost | |
| 3,876,208 | A | | 4/1975 | Wachtler | |
| 3,899,837 | A | | 8/1975 | Harnett | |
| 4,026,557 | A | * | 5/1977 | LeBrun et al. | 273/243 |
| 4,119,322 | A | | 10/1978 | Weigl | |
| 4,173,347 | A | * | 11/1979 | Field, II | 273/261 |
| 4,402,513 | A | | 9/1983 | Head | |
| 4,428,582 | A | | 1/1984 | Smtih | |
| 4,437,670 | A | | 3/1984 | Simon | |
| 4,693,480 | A | | 9/1987 | Smith | |
| 4,702,479 | A | | 10/1987 | Banasiak | |
| 4,795,161 | A | | 1/1989 | Chao | |
| 5,282,633 | A | | 2/1994 | Boylan | |
| 5,489,101 | A | | 2/1996 | Moody | |
| 5,531,448 | A | | 7/1996 | Moody | |
| 5,785,593 | A | | 7/1998 | Wood | |
| 5,820,460 | A | | 10/1998 | Fulton | |
| 5,882,260 | A | | 3/1999 | Marks | |
| 5,887,873 | A | | 3/1999 | Freeman | |
| 5,895,048 | A | | 4/1999 | Smith, Jr. | |
| 6,007,066 | A | | 12/1999 | Moody | |
| 6,131,909 | A | | 10/2000 | Chilese | |
| 6,145,839 | A | | 11/2000 | Katsion | |
| 6,149,155 | A | | 11/2000 | Hoyt | |
| 6,159,098 | A | | 12/2000 | Slomiany | |
| 6,170,828 | B1 | | 1/2001 | Mostashari | |
| 6,220,959 | B1 | | 4/2001 | Holmes | |
| 6,234,481 | B1 | * | 5/2001 | Robertson | 273/243 |
| 6,260,849 | B1 | | 7/2001 | Vanhee | |
| 6,267,669 | B1 | | 7/2001 | Luciano, Jr. et al. | |
| 6,270,405 | B1 | | 8/2001 | Ferguson | |
| 6,322,445 | B1 | | 11/2001 | Miller | |
| 6,332,613 | B1 | * | 12/2001 | Reese | 273/243 |
| 6,354,593 | B1 | | 3/2002 | Frommer | |
| 6,406,023 | B1 | | 6/2002 | Rowe | |
| 6,428,002 | B1 | | 8/2002 | Baranaukas | |
| 6,443,456 | B1 | | 9/2002 | Gajor | |
| 6,447,300 | B1 | | 9/2002 | Greenberg | |
| 2001/0035608 | A1 | | 11/2001 | Hoyt | |
| 2002/0187823 | A1 | | 12/2002 | Khal | |

FOREIGN PATENT DOCUMENTS

| | | |
|---|---|---|
| GB | 1079021 | 8/1967 |
| GB | 2246520 | 5/1992 |
| WO | WO93/15802 | 8/1993 |

OTHER PUBLICATIONS

Office Action in Co-Pending U.S. Appl. No. 10/211,063, dated May 3, 2004.

* cited by examiner

CARD GAME WITH MOVING CARDS

This is a continuation in part of the following applications: Ser. No. 10/156,381 filed May 28, 2002, now abandoned, Ser. No. 10/418,829 filed Apr. 21, 2003 and Ser. No. 10/081,095 filed Feb. 22, 2002.

BACKGROUND

This invention is for a video card game that involves having cards move in various directions and allows the player to use a pointing device to select cards to play.

Video gambling games such as poker, slot machines and blackjack are all well known, as are techniques to award prizes based on payoff tables. This invention transforms these existing games and makes them more eye-catching, challenging and interesting to play.

SUMMARY OF THE INVENTION

In one embodiment of the game, five columns of cards are displayed face-up on a video screen. Each column moves up and down randomly or pseudo-randomly (obviously rows can also be used). Each column can have any number of cards from one or more decks. On the screen there is one or more pointing device that is fixed in place or is controlled by the player using a joystick, buttons, voice command or some other control technique. This pointing device displays a line, or some other visual indication, across the screen that intersects one card in each column. I shall use the term "line," in this patent, but it should be clear that any visual indication that identifies cards to the player would accomplish the same purpose.

When the player believes the line is intersecting the best hand of cards, as the cards move on the screen, he selects those cards using a button, joystick, voice command, or some other control technique, and the cards that the line intersects become the player's hand.

Once the hand is selected, the player can then play the cards in a conventional way. For example, to play poker the player can select certain cards to hold, and get new cards to replace the other cards.

In another embodiment, the player does not have an opportunity to hold or discard cards. Instead, the intersected cards that form the player's hand are compared to a payoff table and the player is paid according to the table.

Similar games could be played for blackjack or other games. To play blackjack, for example, two rows or columns could move in random or pseudo-random motion. The pointing device would display a line across the screen, and, at the player's command, certain cards would be selected. Once the initial hand of two cards is obtained, the player could get additional cards or stick with the ones he received.

In another embodiment, there are five concentric circles of cards. The circles move in opposite directions. So, for example, the inner-most circle could move clockwise and the adjacent circle could move counter-clockwise (or vice-versa). The circles could also all move in the same direction, at the same or different speeds. The cards could all be face up, or certain circles could be face down.

The number of circles could be larger or smaller depending on the game being played. If, for example, blackjack were being played, there could be two concentric circles.

There is one or more line that could be stationary or fixed. The line radiates out from the center of the circles and intersects the moving cards. When the line intersects the cards the player wants, he issues a command with either a button or voice command or some other technique, to select the cards that had been intersected by the line.

If the line is stationary, it could be represented by a horizontally or vertically, and the cards would rotate, but the line would remain fixed. Alternatively, the line could be controlled by the player with a rotating knob, joystick, buttons, voice commands or some other technique to allow player to control the orientation of the line, and thus the cards that were intersected.

In another embodiment, the number of lines available to the player would depend on the amount of money the player wagered. For example, one quarter would get one line, two quarters would get two lines, etc.

Once the cards are selected, the games continues in the normal fashion. For poker, the five cards selected would be displayed and the player would decide which cards he wanted to keep and which ones he wanted to discard.

The player in all these embodiments would be awarded a prize according to a payoff table, as in known in the art.

Another possibility is to this invention in conjunction with the invention set forth in applicant's co-pending application Ser. No. 10/081,095 for cards that have the suit displayed on one side and the value displayed on the other side. In this invention, a six of hearts card would be displayed as a heart in the first instance, but the numerical value of the card would be hidden. If the player selected that card, the value and suit would be displayed together. These cards are called "split representation." For example, some or all of the cards displayed in either the columns or circles embodiments could be split representation. These cards, described in more detail below, when first dealt display either the suit or the rank, but nor both when first dealt. When the player selects the card, both the suit and the rank are displayed together as a conventional card.

DETAILED DESCRIPTION OF THE DRAWINGS

Figure 1:
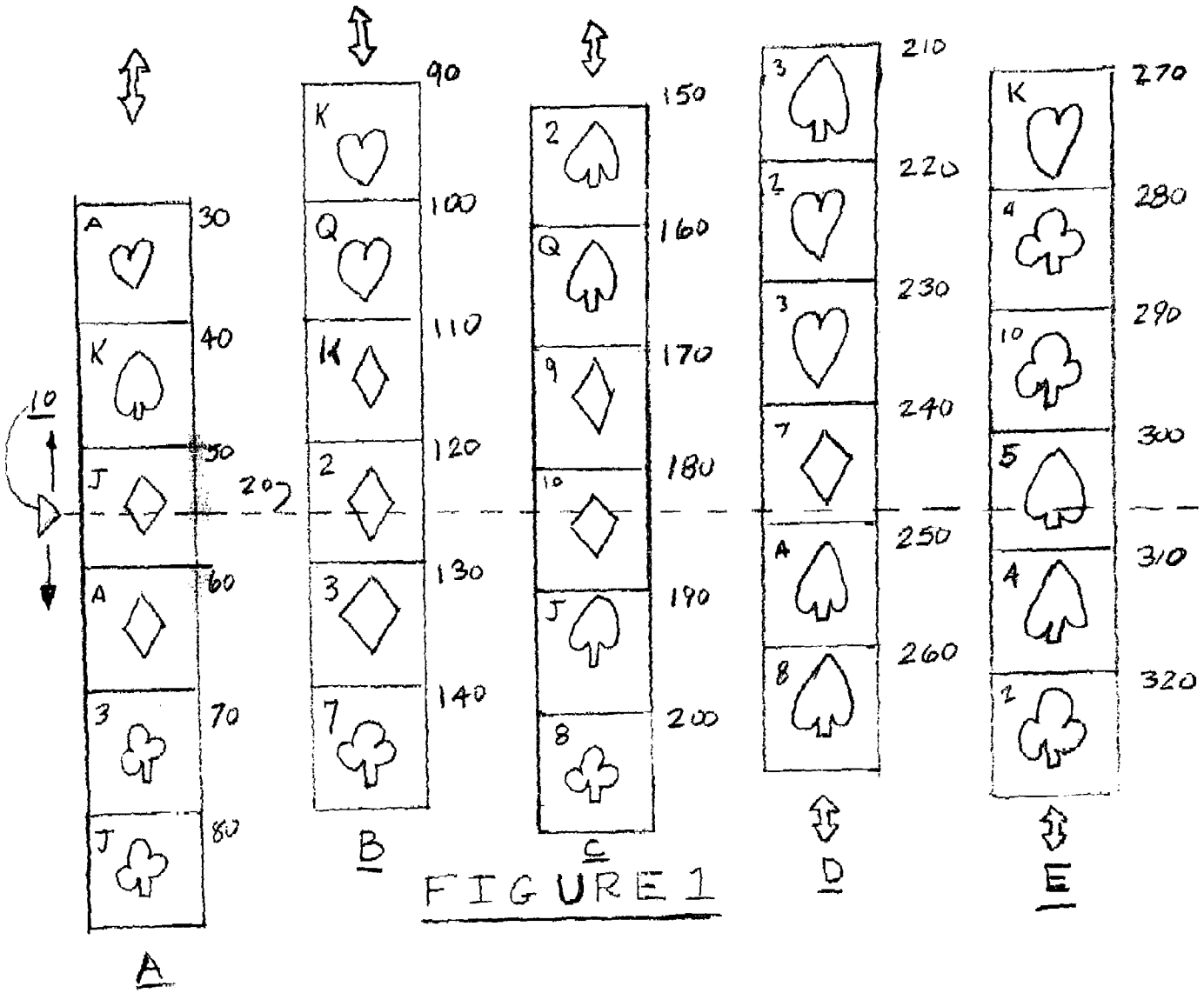
FIG. 1 shows an embodiment of the invention with five columns of moving cards and an indicator for a pointing device on the screen for selecting cards.
Figure 1A:
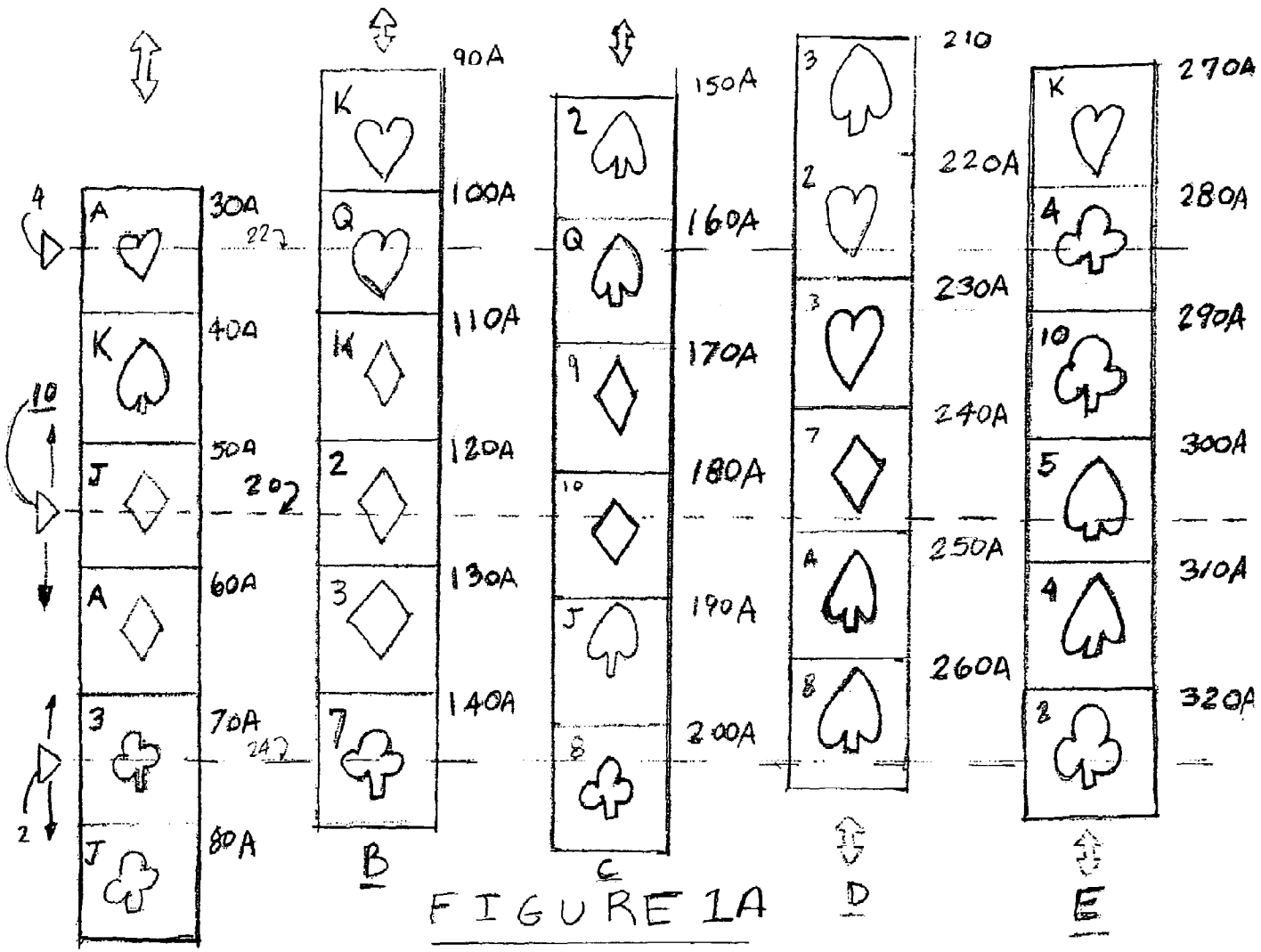
FIG. 1A shows an embodiment with three pointing devices.

FIG. 1 shows an embodiment where there are five columns of cards that move up and down in random or pseudo-random fashion. In FIG. 1 six cards are shown in each column, but any number of cards could be used. Pointing device 10 is shown on the left margin of the Figure, but it could also be in the middle or on the right. In this embodiment, the pointing device moves vertically under the player's control and projects a line across the screen that intersects with cards 50, 120, 180, 240 and 300. In other embodiments the pointing device could be stationary. In FIG. 1A there are three point devices 2, 4 and 10 that allow the player to play three games simultaneously. In this embodiment, the player might be required to pay for each pointing device, and each time another coin is inserted, another pointing device would appear.

Figure 2:
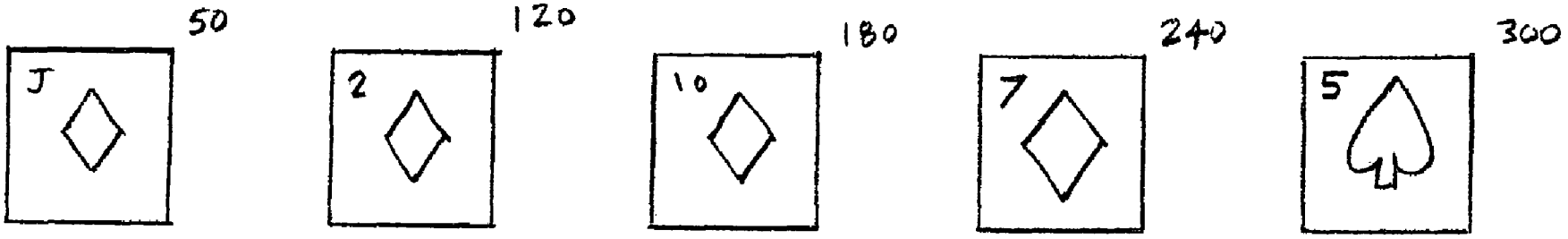
FIG. 2 shows the hand comprised of the cards selected using the embodiment of FIG. 1.

Returning to FIG. 1, after the player triggers the pointing device (and appropriate sounds and visual effects could be used to enhance the player's enjoyment) the intersected cards would be displayed in a group. This group could be on the same screen at the top or bottom, for example; or a separate screen, like FIG. 2, could be displayed to the player. Once the cards were displayed as shown in FIG. 2, the player would be given the option, as in ordinary video poker, to select certain cards to hold. The non-held cards would be replaced with new cards, and the player would be paid according to a standard pay-off table.

The multiple games shown in FIG. 1A would be played similarly. The pointing devices could all move together, so if the player moved his control device (a joystick for example) upward all three pointing devices would move in unison. Alternatively, the three pointing device could be stationary, or they could each be controlled individually. For individual control, it probably would be easier for the player to use them serially, one after the next. In this embodiment, the player would "fire" the top pointing device 4 and select the cards. He would then control and fire the center pointing device 10 and so on.

Three pointing devices are only shown as illustrations, and any number of them could be used. They could be in the center of the screen or on any margin.

Also, this game could be played with cards arranged in rows. If rows were used the pointing device(s) would be at the bottom or top of the screen.

Figure 3:
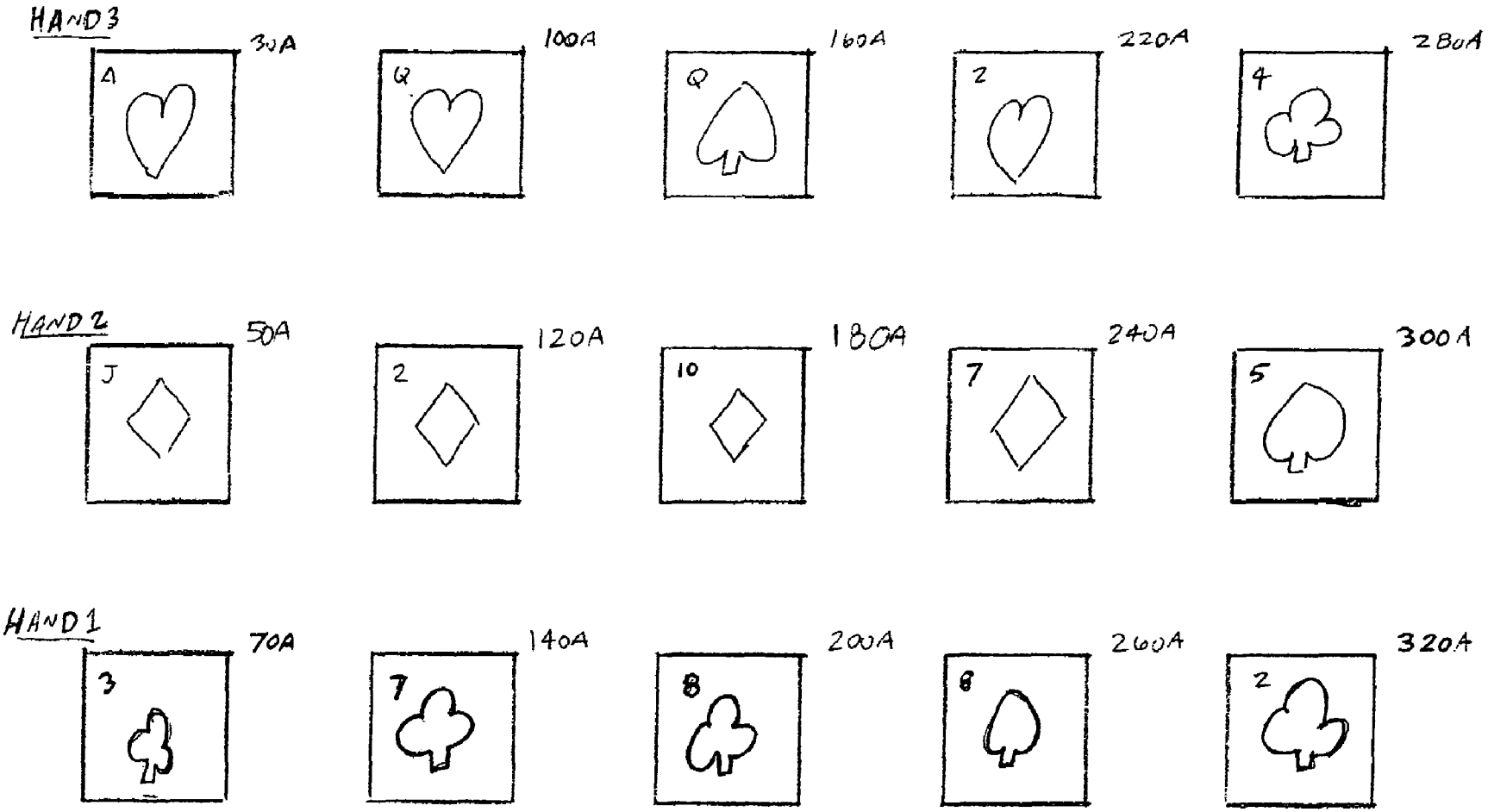
FIG. 3 shows the three hands comprised of the cards selected using the embodiment of FIG. 1A.

Returning to FIG. 2, after the pointing devices are "fired," the intersected cards would be displayed in group on either the same screen or on a different one such shown in FIG. 3. The player would then decide which cards to hold and which to discard. Additional bets could be made at this stage. And the player could also decide to discard a bad hand altogether.

Alternatively, the player would not be given an opportunity to hold or discard his cards and would be paid directly based on the cards that intersected the line.

Figure 4:
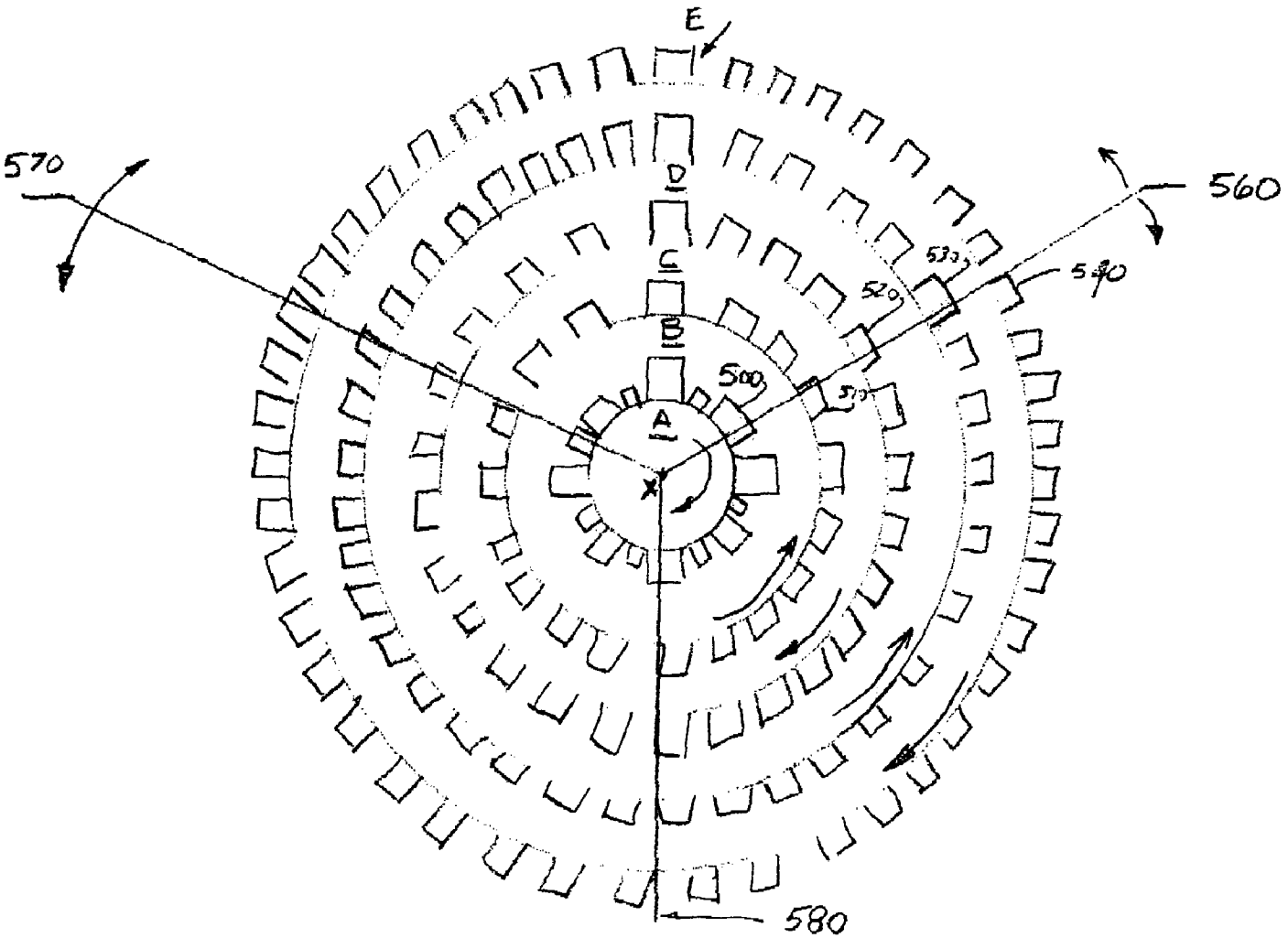
FIG. 4 shows a different embodiment with cards moving in concentric circles and an indicators for up to three pointing devices on the screen for selecting cards.

FIG. 4 shows five concentric circles, each adjacent circle rotates in a different direction. However, all circles could rotate in the same direction at the same or different speeds. And, as with the column version of the game, some circles could have their cards face down, or some could use split representation cards described in applicant's co-pending application Ser. No. 10/081,095.

Figure 6:
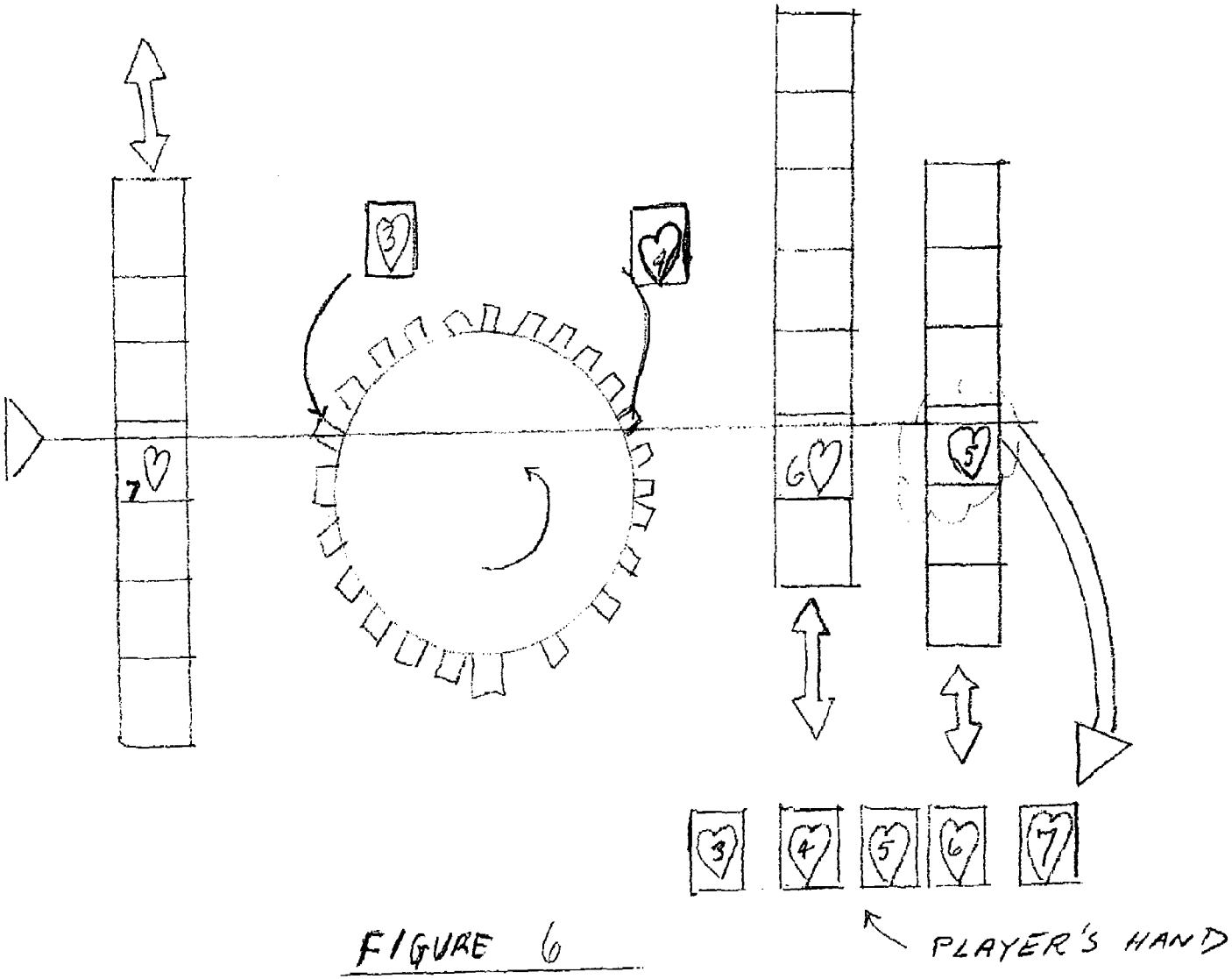
FIG. 6 shows an embodiment with moving cards in a combination of circles and rows or columns, an indicator for one pointing device, and a hand selected using the pointing device.
Figure 8:
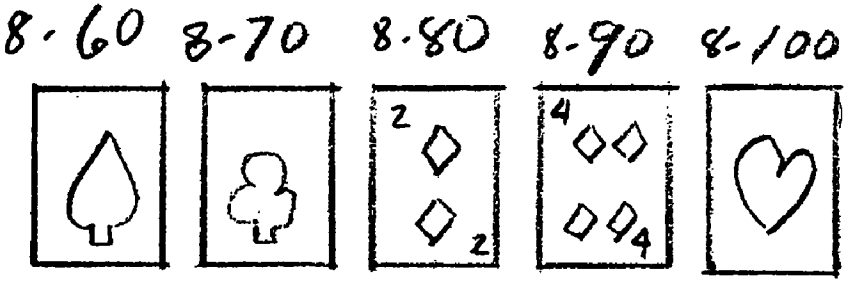
FIGS. 7, 8 and 9 show split representation cards.
Figure 7:
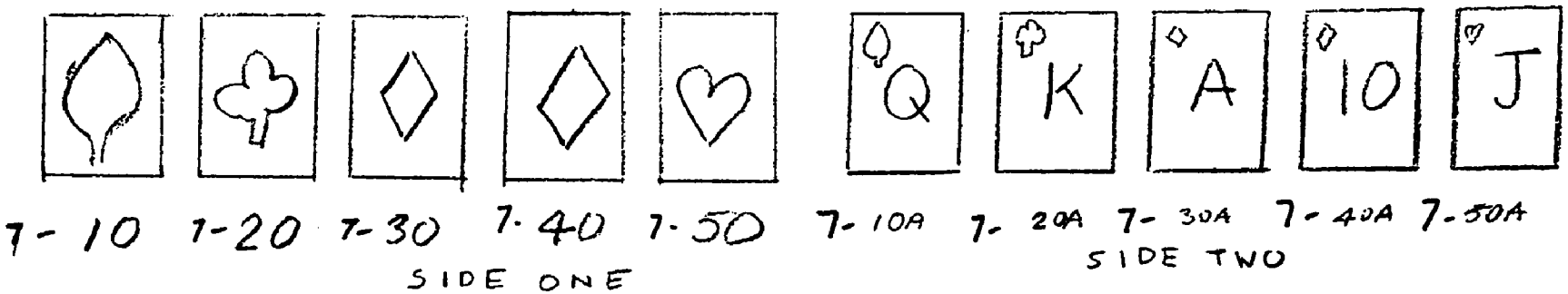

Split representation cards are a new playing, shown in FIGS. 6, 7 and 8. In conventional playing cards, the card either displays both the suit and the rank or the card back that provides no information. By contrast when split representation cards are first dealt, they displays either the suit or the rank, but not both the suit and the rank. When the player selects the card both the suit and the rank are displayed simultaneously.

For example, in FIG. 7 cards 71- to 7-50 (side one) are first dealt. When the player picks the cards, they appear as conventional cards (side two) as 7-10A to 7-50A. When card 7-10 was first dealt, it appeared as a spade (no rank). When the player selected it, the rank was added to the suit and the card appeared as a queen of spade.

FIG. 8 shows conventional and split representation cards together.

Figure 9:
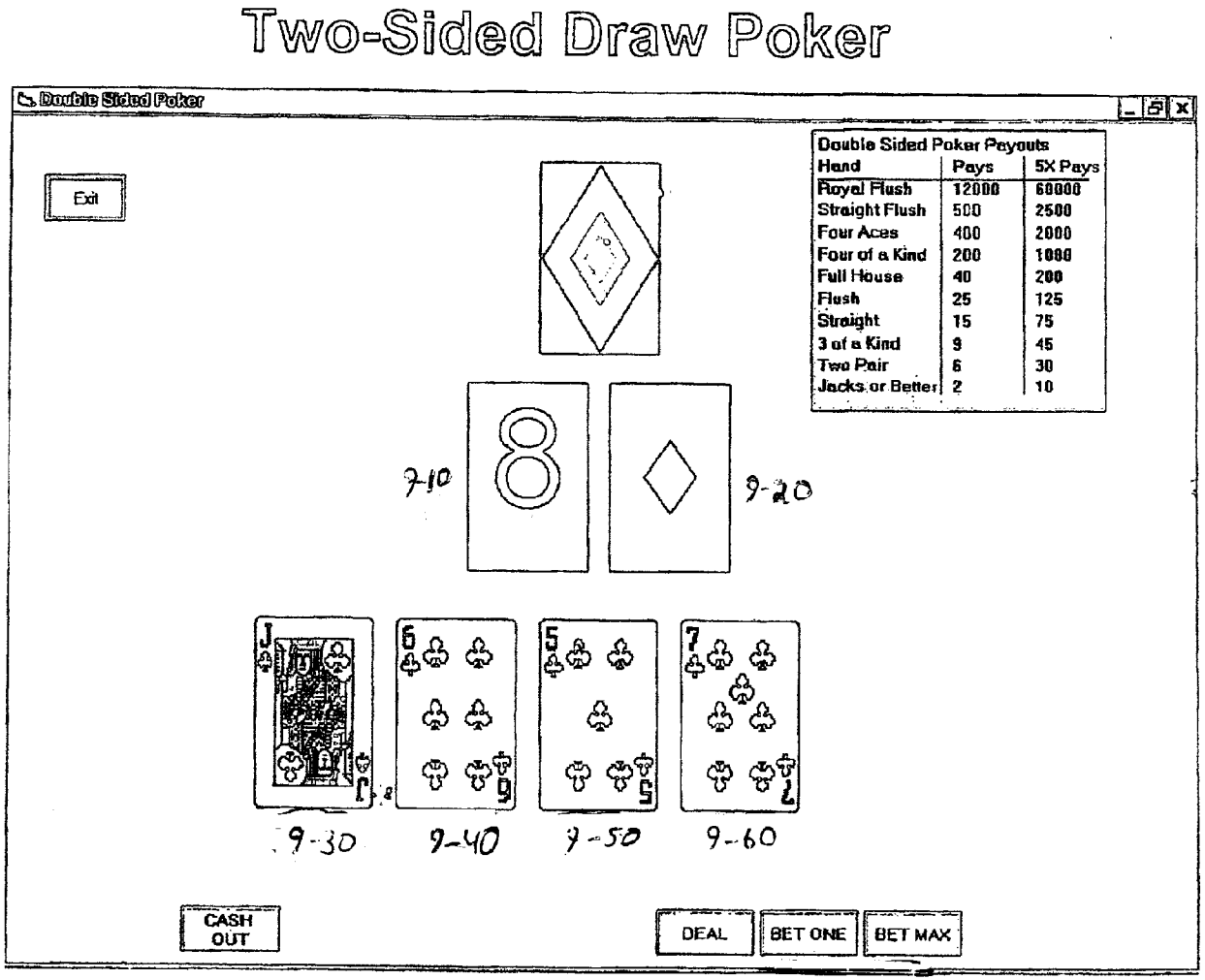

FIG. 9 shown the middle row of cards (9-10 and 9-20) when first dealt. They show either the suit or the rank, but not both together. When the player selects the cards they appear as conventional cards in the bottom row (9-30 to 9-60).

Figure 5:
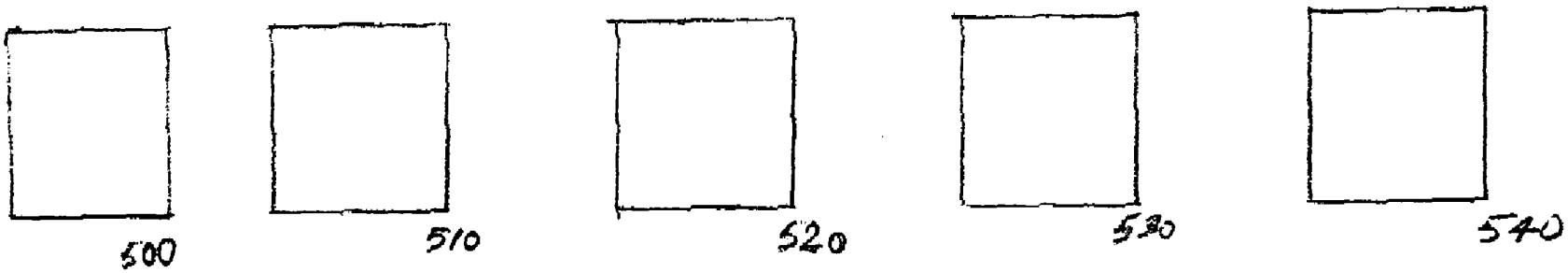
FIG. 5 shows the hand comprised of the cards selected using the embodiment of FIG. 4.

However the cards are displayed, face up or down, the pointing device would send a line emanating from the center of the circles to the outer-most circle that intersects a card in each circle. The cards that were intersected by the line would form the player's hand. In this example, line 560 intersects cards 500, 510, 520, 530 and 540. Those cards would then be displayed in a group as shown in FIG. 5. The player would then select which cards to hold and which to discard. New cards would be provided to replace the non-held cards and the player would be paid off according to a payoff table.

The line created by the pointing device could be fixed or it could be controlled by the user. In the user-controlled embodiment, such as shown in FIG. 4 elements 560 and 570, the pointing device could be controlled by a knob (or any other control device) so that the line rotated around the center point X. Alternatively, the line could be fixed, as shown by element 580.

Here too, the number of lines available to the player could be a function of the amount bet.

Alternatively, the player could be paid off immediately based on the cards that were intersected without being given an opportunity to hold or discard certain cards.

A combination of circles and rows or columns, as shown in FIG. 6, could also be used without departing from the spirit of the invention.

We claim:

1. A method of playing a card game that displays two or more concentric circles; where (a) each circle displays two or more playing cards;

(b) one or more of the concentric circles move (c) one or more visual indicators radiate from the center of the concentric circles and intersect each circle;

comprising:

(d) at the player's command, selecting the card closest to the one or more visual indicators radiating from the center or intersected by the one or more visual indicators radiating from the center in each circle to form the player's hand;

(e) the player holding or discarding the selected cards;

(f) replacing discarded cards; and (g) comparing the resulting hand to a payoff table and paying the player according to the payoff table.

2. The method of claim 1 where selecting the card closest to the one or more visual indicators radiating from the center or intersected by the one or more visual indicators radiating from the center in each circle is to form the player's band is at a randomly determined time.

3. The method of claim 1 where the player controls the movement of the one or more visual indicators radiating from the center of the concentric circles.

4. The method of claim 1 where the one or more visual indicators radiating from the center of the concentric circles is stationary.

5. The method of claim 1 where some of the cards are face down.

6. The method of claim 1 where some or all of the cards are split representation.

* * * * *